US005527625A

United States Patent [19]

Bodnar

[11] Patent Number: 5,527,625

[45] Date of Patent: Jun. 18, 1996

[54] ROLL FORMED METAL MEMBER WITH REINFORCEMENT INDENTATIONS

[76] Inventor: Ernest R. Bodnar, 2 Danrose Crescent, Don Mills, Ontario, Canada, M3B 3N5

[21] Appl. No.: 392,847

[22] PCT Filed: Nov. 25, 1992

[86] PCT No.: PCT/CA92/00514

§ 371 Date: Mar. 1, 1995

§ 102(e) Date: Mar. 1, 1995

[87] PCT Pub. No.: WO94/05872

PCT Pub. Date: Mar. 17, 1994

[30] Foreign Application Priority Data

Sep. 2, 1992 [CA] Canada ..... 2077429

[51] Int. Cl.[6] ..... E04C 3/09; E04C 3/32

[52] U.S. Cl. ..... 428/595; 428/597; 428/603; 52/634; 52/636; 52/733.2

[58] Field of Search ..... 428/598, 603, 428/596, 597, 595; 52/634, 636, 646, 481.1, 735, 731.7, 731.8, 731.9, 733.2

[56] References Cited

U.S. PATENT DOCUMENTS

| | | | |
|---|---|---|---|
| 1,656,810 | 1/1928 | Arnstein | 52/634 |
| 1,983,612 | 12/1934 | Junkers | 189/34 |
| 2,088,781 | 8/1937 | Folsom | 52/634 |
| 2,167,666 | 8/1939 | McGee | 52/634 |
| 2,177,277 | 10/1939 | Burke | 72/115 |
| 2,185,384 | 1/1940 | Rafter | 189/37 |
| 2,187,475 | 1/1940 | Rafter | 52/636 |
| 2,392,818 | 1/1946 | Grafman | 52/636 |
| 2,423,682 | 7/1947 | Castle | 52/634 |
| 3,511,000 | 5/1970 | Keuls | 52/731.9 |
| 4,016,700 | 4/1977 | Blomstedt | 52/731.7 |
| 4,793,113 | 12/1988 | Bodnar | 52/481 |
| 5,157,883 | 10/1992 | Meyer | 52/731.9 |

FOREIGN PATENT DOCUMENTS

| | | | |
|---|---|---|---|
| 53970 | 10/1974 | Australia | 52/634 |
| 527072 | 9/1956 | Belgium . | |
| 1603516 | 11/1981 | United Kingdom . | |
| WO89/3920 | 5/1989 | WIPO | 52/634 |

*Primary Examiner*—John Zimmerman

*Attorney, Agent, or Firm*—Jon Carl Gealow; Keck, Mahin & Cate

[57] ABSTRACT

A metal member having at least one edge formation, and a web extending from the edge formation, a plurality of generally triangular openings formed in the web at spaced intervals, the triangular formations being alternately reversed relative to one another, a plurality of generally diagonal struts extending between adjacent triangular openings, edge portions along either edge of the web portion, with the struts extending from one said edge portion to the other and merging integrally therewith, flange formations formed from the web around the generally triangular openings, and lying at an angle thereto, whereby to form the diagonal struts with a generally channel shaped cross section, and forming intermittent flanges along the web edges at the base of each triangular opening, the triangular openings defining generally curved corners, and, generally three-sided indentations formed in the web edge at the roots of each of the diagonal struts.

13 Claims, 9 Drawing Sheets

FIG. 7
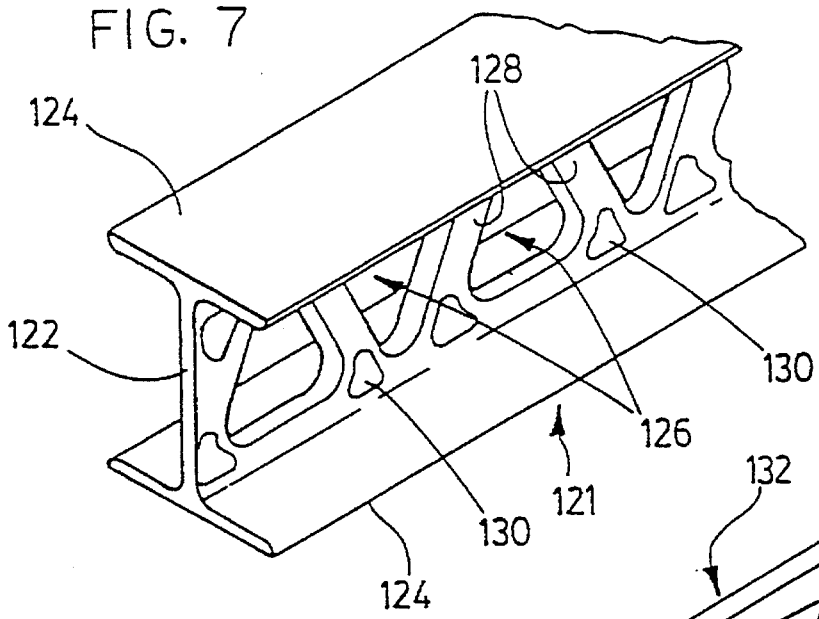
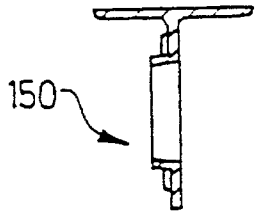
FIG. 10
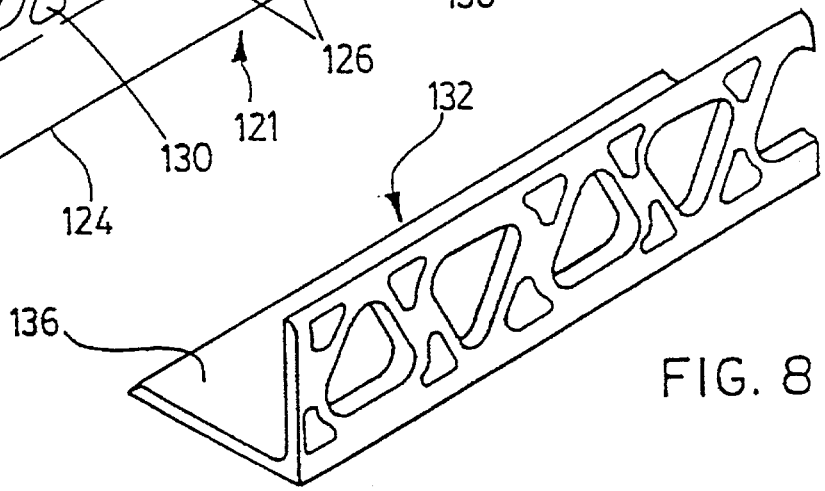
FIG. 8
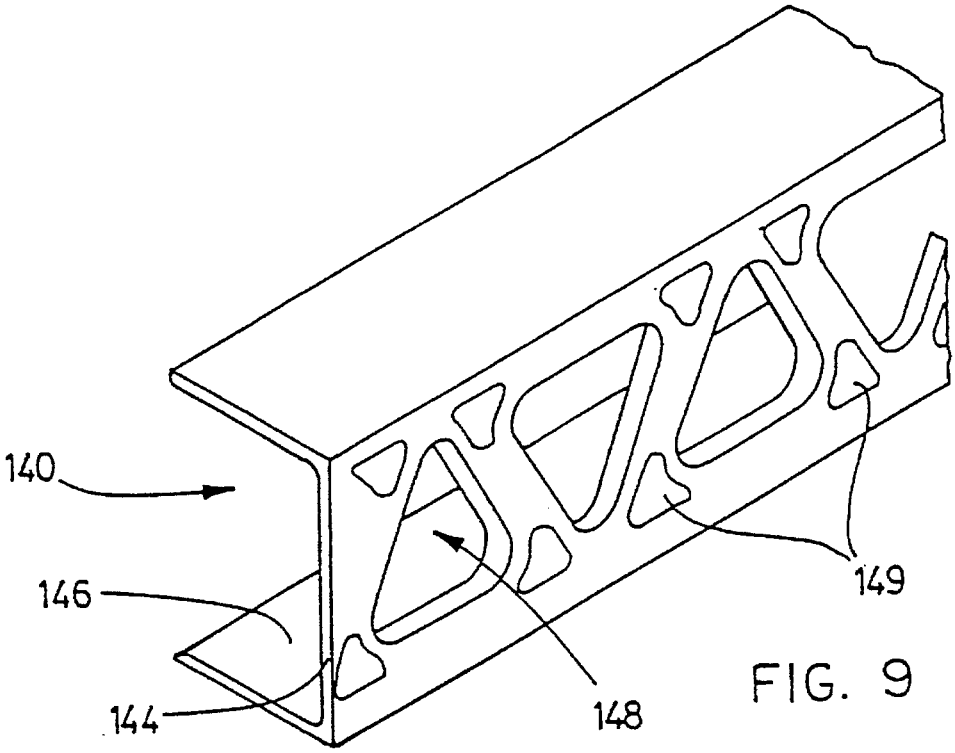
FIG. 9

ROLL FORMED METAL MEMBER WITH REINFORCEMENT INDENTATIONS

TECHNICAL FIELD

The invention relates to a roll formed metal member having generally axially located recesses and defining transverse struts therebetween. The invention further relates to a metal member having generally three-sided indentations formed therein adjacent to the ends of the struts.

BACKGROUND ART

Roll formed metal members may be used for a variety of purposes, as either structural load bearing members, or as beams of various kinds, or in many non-load bearing applications.

Such members may be of a variety of cross-sections. One typical member has a generally C shaped cross-section. Other members may have a cross-section similar to a Z, and other members may be of a T shaped cross section or an I shaped cross section to name only a few.

In all cases, however, it is desirable that whatever the section of the member, it should have certain characteristics.

It should be strong enough to carry the load for which it is designed, in the case of a load bearing member, and even in the case of such members which are strictly speaking non-load bearing members, it shall at least have sufficient strength to withstand the forces to which it will be subjected in normal use.

It should be capable of being fabricated at high speed by roll forming to minimise production costs.

It should use a minimum quantity of metal, for a given length, in order to both minimise cost and reduce weight.

Numerous proposals have been made in the past for designing such metal members having both reduced weight, and increased strength, as compared with a plain unformed section.

Such proposals are almost too numerous to mention, but are usually based on some form of combination of openings formed through the member, or some form of indentations, or flanges, formed in the member so as to increase its strength and thus permit the thickness of metal to be reduced, for a given load or application. One of the principal problems with most of the earlier proposals of this type is that it was simply impossible to manufacture them by known manufacturing techniques, in an economical manner.

Continuous cold roll forming techniques for forming longitudinal formations in sheet metal, and hot rolling were not capable of both the piercing of openings through the metal, and also forming indentations or flanges. For many years, no equipment was known which was capable of carrying out these functions on a continuously moving piece of metal moving along a forming line. Accordingly, most of these earlier proposals have been impractical, since they could only be made on a typical stationary press. Recent developments in rotary forming apparatus are disclosed in U.S. Re. Pat. No. 33,613 entitled Rotary Apparatus, Inventor E. R. Bodnar, and U.S. Pat. No. 5,040,397 entitled Rotary Apparatus and Method, Inventor E. R. Bodnar.

Using this type of apparatus, it is now possible to manufacture a wide variety of different products, in which openings can be pierced or formations formed, in a continuously moving bar or strip of material. Examples of continuously formed strip sheet metal products are shown in U.S. Pat. No. 4,909,007 entitled Steel Stud and Precast Panel, Inventor E. R. Bodnar and U.S. Pat. No. 4,793,113 entitled Wall System and Metal Stud Therefor, Inventor E. R. Bodnar.

Using these new manufacturing techniques, it has been found possible to produce structural load bearing and non-load bearing sheet metal products having both transverse formations, openings, flanges, and longitudinal formations. A combination of some or all of these formations greatly increases the strength capacity of the structural member and consequently enables the thickness of the sheet metal to be reduced. For example, in the structural member shown in U.S. Pat. No. 4,793,113, the member is formed with generally triangular or trapezoidal shaped openings, which openings define between them generally diagonal struts. Edge flanges were formed along either side of the struts and around the sides of the openings. Roll formed continuous angle formations were formed along either side of the member. In this way, it was possible to provide for example, a light weight structural member for use in interior construction in buildings such as the supporting of interior walls and the like, using thin gauge sheet metal. The uses of the invention described in that patent are in no way limited to such a thin gauge material, but the invention had particular utility in that connection, since it also provided generally transverse indentations alongside the struts, and in the angle formations. These transverse indentations reduced the tendency of the roll formed angle portions to flex.

It was also surprisingly found that these formations also reduced the flexibility of the web portion of the structural member, between the roll formed longitudinal angle formations, and this factor still further enhanced the resistance of the stud to flexing. This surprising and unexpected result has led to further developments to still further enhance the rigidity both of thin gauge structural members and also of much heavier gauge structural members of various widths, for heavy duty load bearing uses.

While up to this point, the characteristics of metal products described above, have generally speaking been formed of strip sheet metal in cold forming processes, it has now further been determined that by the use of some, or all of the inventive features about to be described, the performance of both cold rolled and hot rolled metal members may be substantially improved. In the past, hot rolled metallic members typically being flat steel bars, girders, joists, lipped angles, and plain channels, and the like have been hot rolled from a heated billet usually of steel (and/or ferrous and non-ferrous metals), and then allowed to cool, and then cut to length. These products generally had relatively primitive continuous sections described above, typically, having a continuous planar web, and one or more edge formations.

Such hot rolled structural members are formed in various thicknesses and dimensions for various different applications. Clearly, the same observations apply namely that if the hot rolled members can be increased in strength by certain formations, which are formed in them, then the thickness of metal in the member may be reduced thereby reducing its weight and its cost.

DISCLOSURE OF THE INVENTION

With a view to solving the various conflicting objections noted above, the invention comprises a metal member having at least one edge formation, and a web extending from said edge formation, and comprising, a plurality of recesses formed in said web at spaced intervals, along a generally median axis thereof, a plurality of struts extending across said web between adjacent said recesses at an angle to said median axis, edge portions along either edge of said web, with said struts extending from one said edge portion to the other and merging integrally therewith, flange formations formed from said web around said recesses, and lying at an angle thereto, whereby to give said struts a generally channel shaped cross section, and whereby also to form intermittent flanges along said web edges, and, generally three-sided indentations formed in said web, at each end of each of said struts.

The invention further comprises a metal member as described and wherein said web defines between said recesses, enlarged end portions of each of said struts.

The invention further comprises a metal member as described and wherein said three-sided indentations are indented into said web and extend partially into each end of each said strut.

The invention further comprises a metal member as described and wherein said three-sided indentations each comprise a base side which is linear and generally parallel with a said edge of said web, at least a first curved side extending from said base linear side and meeting a third said side at an apex, and wherein said apex extends into a respective said strut portion of said web.

The invention further comprises a metal member as described and wherein said curved edge of said generally three-sided indentation is spaced from an adjacent said recess, thereby defining a first generally curved strut root portion.

The invention further comprises a metal member, as described and wherein said member is a hot rolled steel member, having a web portion, and wherein said recesses and said indentations are formed in said web portion.

The invention further comprises a metal member, as described and wherein said member is a cold rolled steel strip member, and including two said edge formations, extending along opposite edges of said web, defining a generally channel shape in cross section, and wherein said recesses said flange formation extending from web on the same side as said edge formation.

The invention further comprises a metal member as described and wherein having an edge formation extending to one side of said web, and wherein said flange formations around said recesses, and wherein said indentations extend to the opposite side of said web.

The invention further comprises a metal member as described and wherein said recesses are of generally triangular shape and define a first side parallel with a said edge of said web, and two further sides extending diagonally, and wherein curved base corners extend between said first side and said further sides, and wherein said further sides meet at a curved apex corner, and wherein said struts are defined by diagonal portions of said web between adjacent said triangular recesses and wherein said apex corner of one of said triangular recesses and an adjacent curved base corner of another said triangular recess, define between them enlarged end portions at each end of each of said struts.

The invention further comprises a metal member as described and wherein said flange formations around said corners of said generally triangular formations lie at an oblique angle relative to the plane of said web.

The invention further comprises a metal member as described and wherein said three-sided indentations comprise a base side which is linear and generally parallel with a said edge of said web, a first linear angled side extending from said base linear side, and a third curved side extending from said base linear side and meeting said second linear side at an apex, and wherein said apex extends into said enlarged end portions of said struts.

The invention further comprises a metal member as described and wherein said second linear edge portion of said three-sided formations extends generally parallel to and spaced from a linear edge of portion of one of said web portion, whereby to define a substantially linear strut portion extending from said web into said respective diagonal strut, and spaced from said curved strut portion, whereby each said diagonal strut extends from both a generally curved strut portion and a linear strut portion extending from said web.

The invention further comprises a metal member as described and wherein said recesses are generally circular and including generally continuous curved flange formations formed around said circular recesses.

The invention further comprises a metal member as described and wherein said three-sided indentations each comprise a base side which is linear and generally parallel with a said edge of said web, and first and second curved sides extending from said base linear side and meeting at an apex, whereby to define two substantially arcuate strut root portions extending from said web into each end of each said respective strut, whereby each said strut extends from both said generally curved strut root portions extending from said web.

The invention further comprises a metal member as described and wherein said recesses define openings through said web.

The invention further comprises a metal member as described and having a plurality of generally triangular formations formed in said web at spaced intervals, said triangular formations being alternately reversed relative to one another and defining a base and three corners, a plurality of generally diagonal struts extending across said web between adjacent said triangular formations, edge portions along either edge of said web, with said struts extending from one said edge portion to the other and merging integrally therewith, first flange formations formed from said web around said generally triangular formations along each side of said struts, and lying at a predetermined angle to said web, whereby to give said diagonal struts a generally channel shaped cross section, second flange formations formed along a further side of said triangular formations and forming intermittent flanges along said web edges, at said base of each said triangular formation, and, corner flange formations extending around said corners of said triangular formations, said corner flange formations lying at an angle to said web which is less than said predetermined angle of said first flange formations.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

FIGS. 7, 8, 9 and 10 are schematic perspective illustrations of further alternate embodiments of metal member in accordance with the invention;

MODES OF CARRYING OUT THE INVENTION

Figure 1:
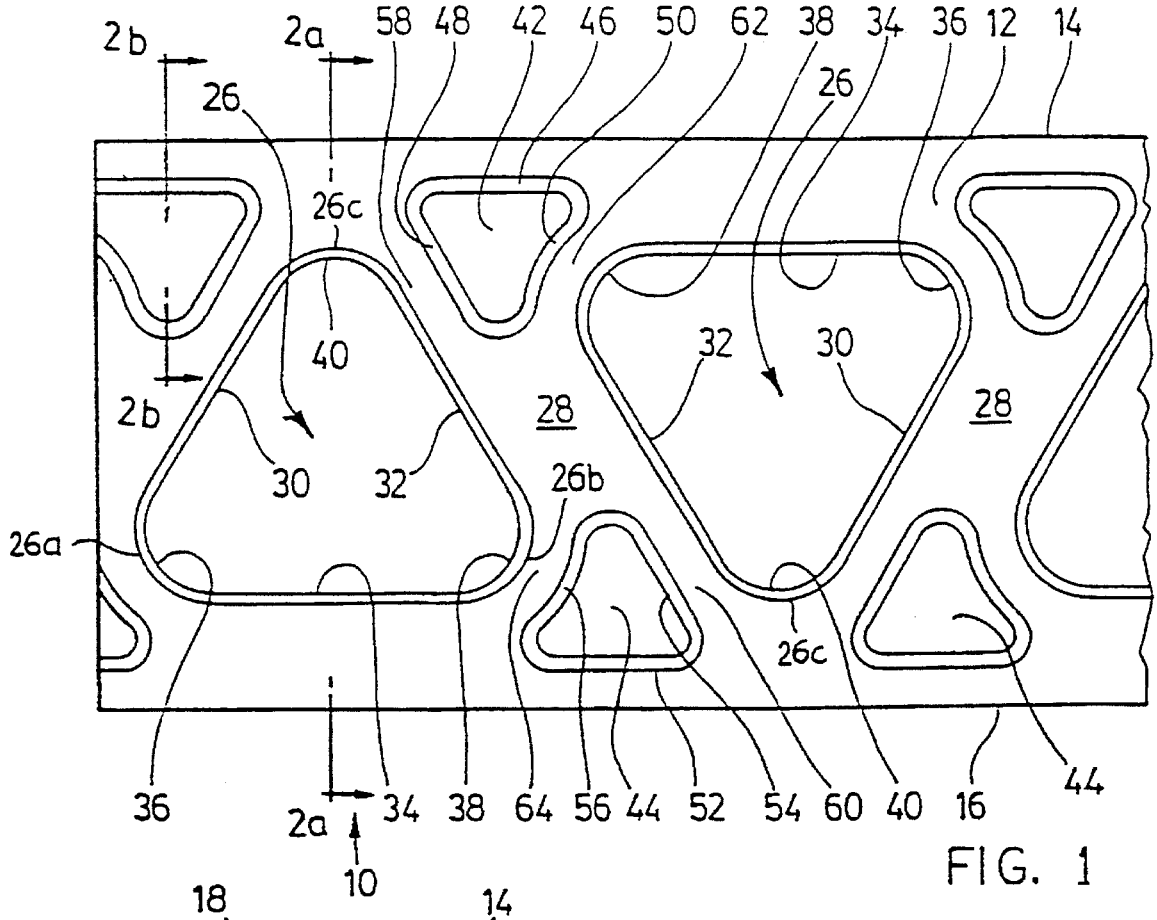
FIG. 1 is a side elevational view of a portion of a metal member in accordance with the invention.

Referring first of all to FIGS. 1, 2*a* and 2*b* and 3, the invention will be seen to comprise a metal member indicated generally as 10. The member 10 may be considered simply as a lightweight strut, or as a load bearing stud, or as a transverse beam, and may be used in various thicknesses and in various load bearing specifications. In this case it will be seen to be formed of cold rolled sheet metal, typically steel (or other ferrous or non-ferrous metals).

The member 10 consists of a web portion 12, defining two web edges 14 and 16.

Formed integrally with the web, edges 14 and 16, are right angular spacer strips 18 and 20, having in-turned corners 22 and 24.

A series of recesses, in this case, generally triangular shaped openings 26*a*–26*c* are formed in web 12, at spaced intervals.

Alternate recesses 26 face in opposite directions, so as to define generally transverse, diagonal struts 28 there-between extending across the web between one side edge 14 and the other side edge 16 of the web 12.

Around each of the recesses or openings 26, side edge flange formations 30, and 32 and base edge flange formations 34 are formed. Edge flange formations 30, 32, and 34 are linear openings 26 define base corners 26*a*–26*b* and an apex corner 26*c*. Around each of the corners of the openings 26, curved flange portions are formed at 36, 38 and 40. The flanges in fact are continuous, and are formed at an angle to the plane of the web 12.

Figure 2A:
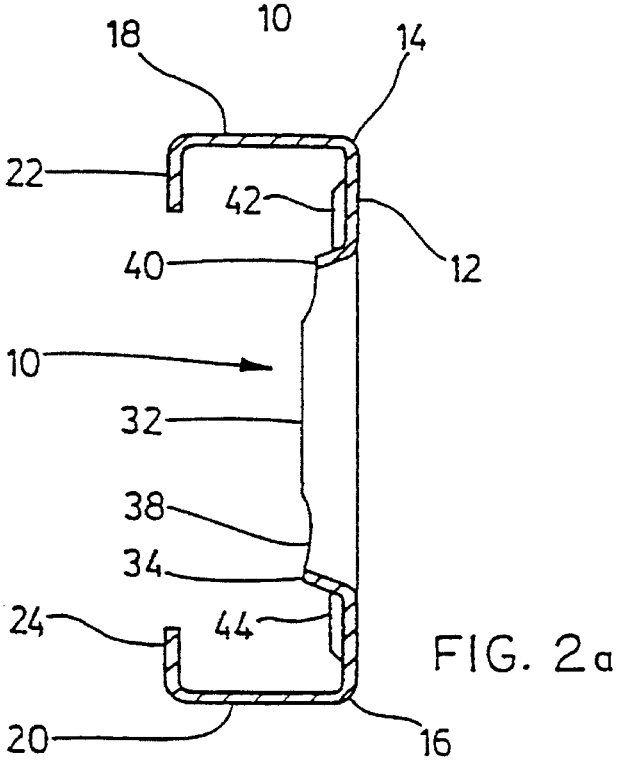
FIG. 2*a* is a section along the line 2*a*—2*a* of FIG. 1.
Figure 2B:
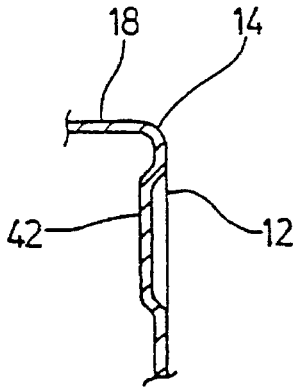
FIG. 2*b* is a section along the line 2*b*—2*b* of FIG. 1.

It will also be seen that each of the strut portions 28 between adjacent openings 26 have a general channel shape in cross-section. The linear flange portions 30, 32 and 34 are somewhat deeper than the corner flange portions 36, 38 and 40 (FIG. 2*a*).

It will be noted that the two corner flange portions 36 and 38 join with the linear edge flange 34, which in turn is parallel with the edge 16 of the web 14.

The two remaining linear flange portions 30 and 32 meet at the curved flange portion 40, which is herein termed the apex of the opening.

Each end of each strut 28 is thus somewhat enlarged, and is termed herein the root portion of the strut, where it merges with its adjacent edge 14 or 16 of web 12 respectively.

Within this enlarged root portion of each end of each strut, there are formed respective generally three-sided depressions 42–44. Depression 42 has a base linear side 46, and an angled linear side 48, and a generally curved side 50.

Similarly, depression 44 has a linear base side 52, and a linear angled side 54 and a curved side 56.

The depression (42, 44) define indented web portions of three sides shape extending between the linear base sides (46, 52), the angled linear sides (48, 54) and the curved sides (50, 56) respectively.

It will be observed that in depression 42, the linear angled side 48 is spaced from the edge flange 32 of the adjacent opening 26, and is essentially parallel to it.

The curved side 50 of depression 42 is spaced from the curved flange 38 of the adjacent opening 26, and is curved in such way as to essentially complement the curvature of the flange 38 around the corner of the opening.

The depression 44 is essentially a mirror image, in layout, as compared with the depression 42.

In this way, the depressions 42–44 define linear strut root portions 58–60 and curved strut root portions 62–64.

Each of the indentations 42–44 define respective apices 66 and 68, extending from the root portions inwardly along the length of their respective diagonal struts 28.

A metal member when formed with these formations is found to possess greatly increased rigidity across the width of the web 12 i.e. from one edge 14 to the other edge 16, as compared with earlier metal members.

Figure 4:
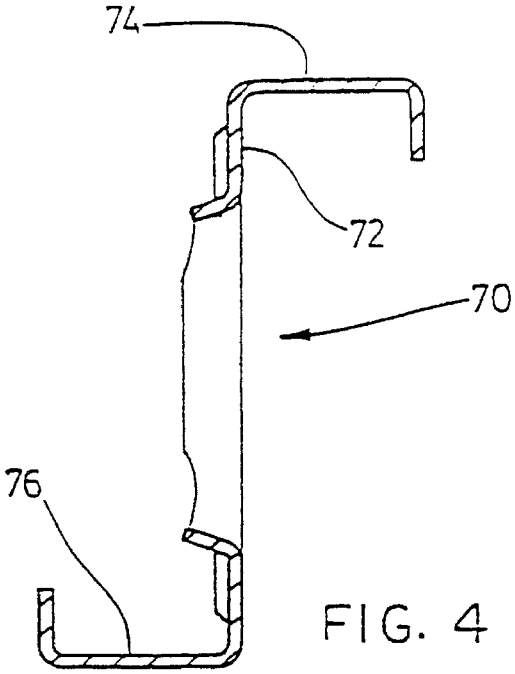
FIG. 4 is a section of an alternate embodiment of the metal member.

Referring to FIG. 4, a further embodiment of the invention is illustrated wherein the metal member has a generally Z-shaped configuration. In this case, the metal member 70 has a web portion 72 similar to the web 12 of the embodiment of FIGS. 1, 2 and 3. However, the member 70 has facing panel members 74 and 76, which are offset on opposite sides of the web 72.

Figure 3:
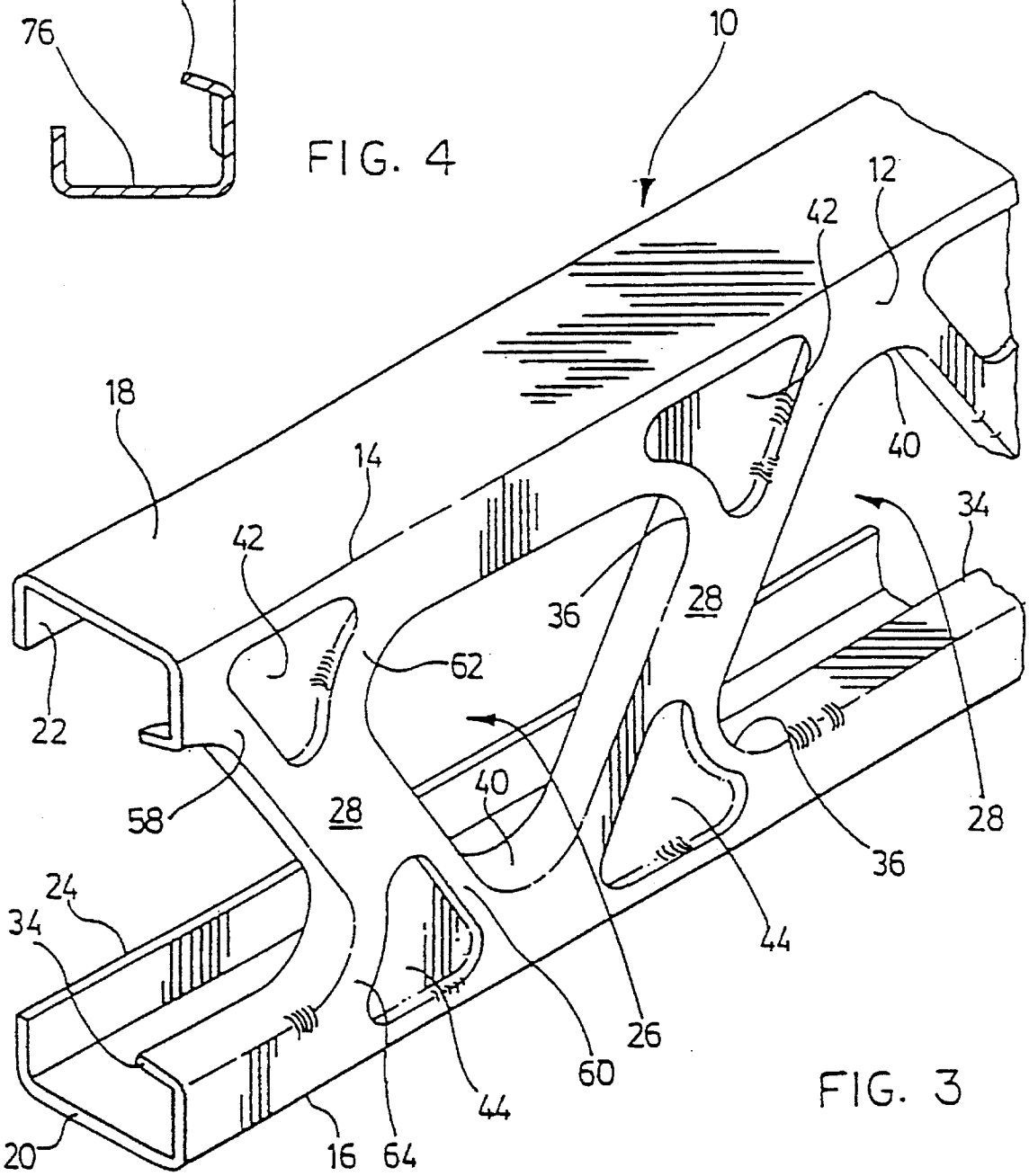
FIG. 3 is a perspective illustration of a portion of the metal member of FIG. 1.

Otherwise its construction is essentially the same as that described in connection with the embodiment of FIGS. 1, 2 and 3.

Figure 5:
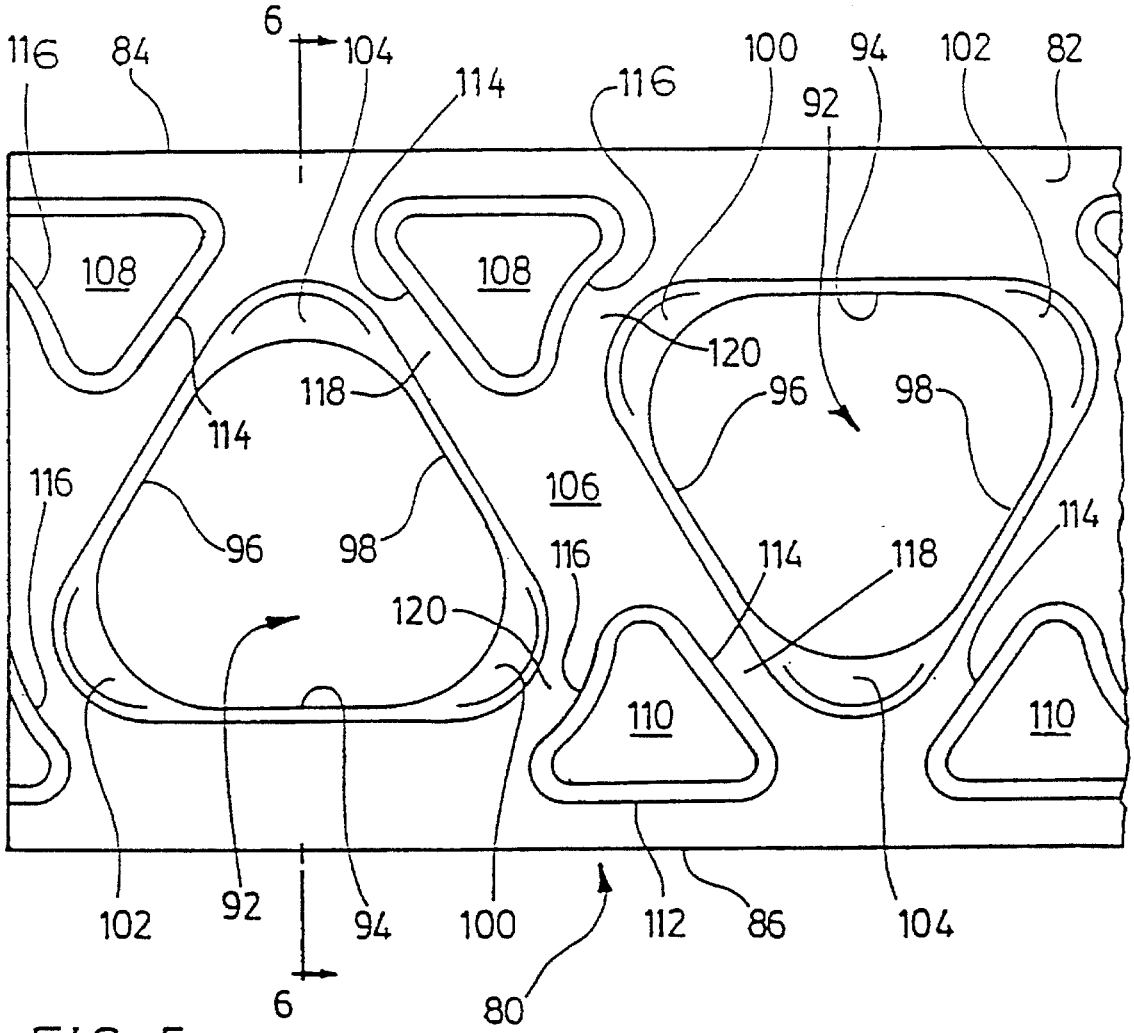
FIG. 5 is a side elevational view a further embodiment of the metal member.
Figure 6:
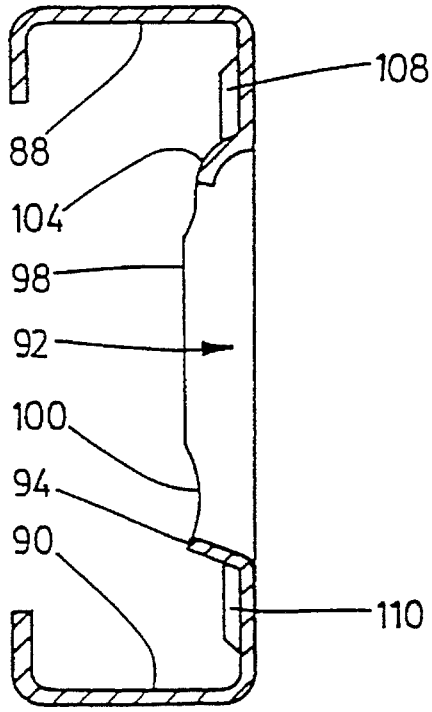
FIG. 6 is a section along line 6—6 of FIG. 5.

Referring now to FIGS. 5 and 6, a still further embodiment of the invention is illustrated. In this case, the metal member indicated generally as 80 has a web portion 82, and edges 84–86. Support panels 88 and 90 extend at right angles from the edges 84 and 86, as in the embodiment of FIGS. 1, 2 and 3.

In this embodiment however there are openings 92—92 formed through the member at spaced intervals, and being alternately reversed relative to one another. They may also be described as being "generally" triangular in shape. However, it will be seen that their configuration is somewhat in the form of a distorted triangle. Thus these openings have generally linear side flange formations namely the base flange formation 94 and the two side flange formations 96 and 98.

However, where the side flange formations meet the base flange formations generally scoop shaped corner flanges 100 and 102 are formed.

Where the side flanges meet at the apex of each opening, a generally scoop-shaped corner flange 104 is formed.

Referring specifically to FIG. 5, it will be seen that whereas the linear flange formations 94, 96, 98 are angled relative to the plane of the web 82 at an angle of somewhere between 75° and 85°, the scoop formations 100, 102 and 104 at the corners are less steeply angled relative to the plane of the web.

The scoop formations may be either generally curved in section (FIG. 6) or may be angular in shape, so as to define a first more steeply angled portion and a second less steeply angled portion. The general objective being, in either the scoop formation or the angled formation, to insure that the scoop shaped flange portions extending around the corners of the triangles are formed in such a manner as to provide an adequate extent of metal throughout the corner flange portions, without deforming them out of the plane of the web to the extent that it would cause weakening of the flange portions in these corner areas.

The net result, as indicated generally in FIG. 5, is that these corner flanges 100, 102, 104, appear somewhat in the shape of a scoop or saucer section in elevation, compared with the linear flanges 94, 96, 98 which are substantially deflected out of the plane of the web 82.

Comparison of FIG. 5, with FIG. 6, will reveal these differences.

In this way, it is possible to form the openings 92—92 along the length of the metal member, while maintaining greater strength through the curved corners 100, 101, 102, 104.

As in the embodiments of FIGS. 1, 2, 3, and 4, the metal members 80 define diagonal struts 106—106 extending between the openings 92—92. At each end root portion of the diagonal struts 106, there are formed generally three-sided depressions or indentations 108 and 110. As before, each of the three-sided depressions 108, 110 define linear base edges 112, and linear side edges 114, and generally curved side edges 116.

The base linear side edges 112 are substantially parallel to the edges 84 and 86 of the web 82. The linear side edges 114 are substantially parallel to the side flanges 96.

The curved side edges 116 of the depressions 108, are curved so as to be complementary to the curved flanges 100 of the openings 92.

Thus on the one side of the depressions 108, and 110, there are defined generally linear strut portions 118—118. On the opposite sides of the depressions 108 and 110, there are defined generally curved strut portions 120—120.

These two strut portions 118 and 120, being separated by their respective depressions 108 and 110, add materially to the strength and rigidity of the web 82, and produce a metal member having greatly improved structural load-bearing capabilities.

As mentioned above, the same features may be applied to various different forms of metal members both cold rolled and hot rolled.

For example, in FIGS. 7, 8, 9 and 10 there are disclosed four different examples of hot rolled metal beams and sections, described below.

All of the sections may be materially increased in strength by the use of the invention, in which generally triangular openings are formed, which are all alternately reversed relative to one another as has been described in the embodiments of FIGS. 1 to 6. In addition, depressions are formed, adjacent the ends of the struts defined by the triangular opening, and flanges are formed around the triangular opening, in the same manner as is illustrated in FIGS. 1–6.

Typically, sections such as FIGS. 7, 8, 9 and 10 will be formed of hot rolled ferrous and non-ferrous metals. The strength of such metal members can be greatly increased by the use of the invention, and this will either increase the strength or permit the use of such metal members having a reduced metal content, to provide the same degree of load bearing capacity. In either case, substantial advantages will be achieved in accordance with the invention.

Figure 11:
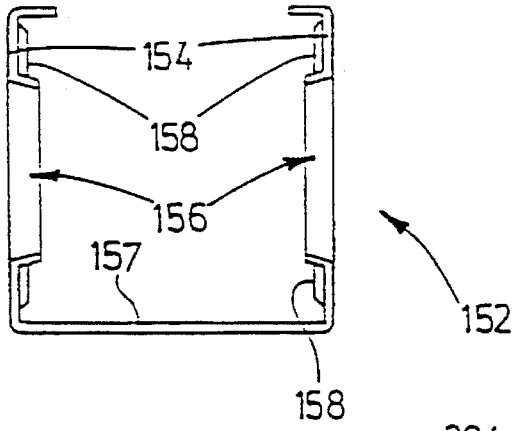
FIGS. 11, 12, 13, 14 and 15 are schematic end views of further metal members incorporating the invention.
Figure 12:
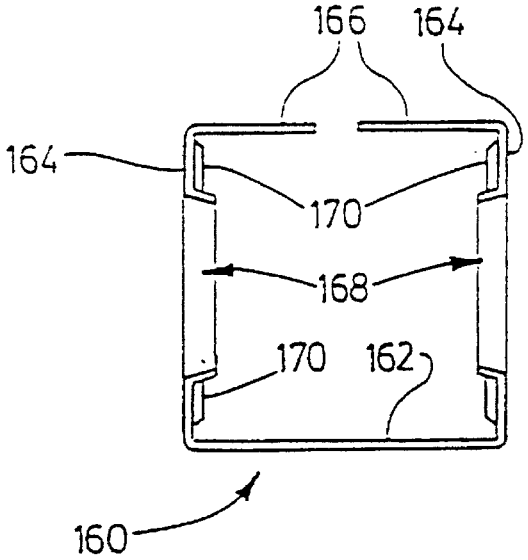
Figure 13:
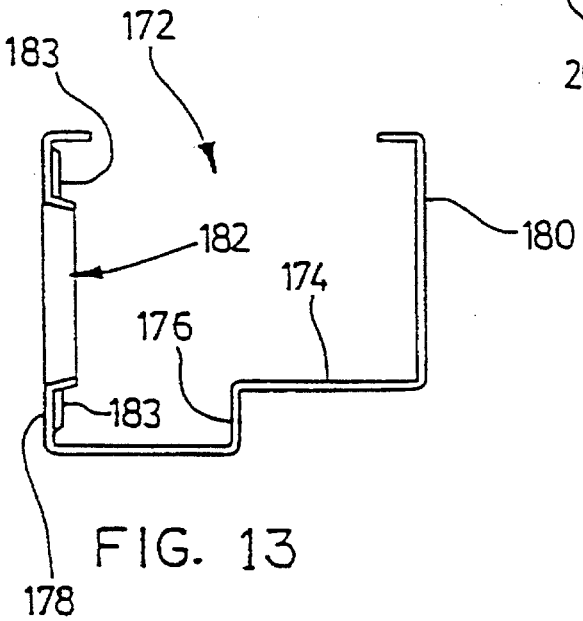
Figure 14:
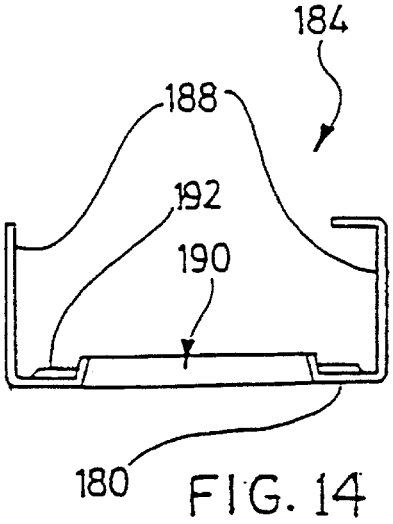

Similarly, a variety of other cold formed sections can be materially increased in strength and/or reduced in metal content, as is illustrated in FIGS. 11, 12, 13, and 14. FIGS. 11 and 12 illustrate two different forms of channel. FIGS. 13 and 14 illustrate two different forms of cold formed metal sections, (described below) which may be desirable in some cases. In all of these cases, by the use of the invention, employing alternately reversed triangular openings, and triangular indentations at the roots of the struts formed by these triangular indentations, substantial improvements in load bearing capacity can be achieved, and/or substantial reductions can be achieved in the thickness of the metal required to produce an equivalent load bearing capacity.

It will be appreciated that the invention can be applied to a wide variety of different sections of metal members (both ferrous and non-ferrous) as mentioned above. The invention can be applied, for example, to hot rolled metal members. Usually, hot rolled metal members have less complex sections than cold rolled members. Typical hot rolled metal sections are shown in FIGS. 7, 8, 9 and 10. As shown in FIG. 7 for example, a typical hot rolled section may be in the shape of what is known as an I-beam 120. Such an I-Beam will have a central planar web 122, and two transverse edge formations 124. In this embodiment, triangular openings 126 would be formed in the central web, defining struts 128. Generally triangular depressions 130 such as those described above would be formed in the web at either end of the depressions. The beam 132 of FIG. 8 and the beam 134 of FIG. 9 and the beam 136 of FIG. 10 would all have similar triangular openings, and flanges and depressions, as shown.

In some embodiments, such depressions, and the flanges surrounding the openings, could be formed offset alternately to one side and to the other of the web, if this were desirable.

In the embodiment shown in FIG. 8, the metal member 132 is in the form of a simple L shaped angle, having 134, and a right angular flange portion 136. Triangular openings as before, could be formed. Triangular openings are shown formed through the web, and triangular indentations are formed in the web.

Another typical hot rolled section is shown in FIG. 9, in the form of a simple channel 140. Such a member would have a web 144, and two edge flanges 146. Triangular openings 148 are formed in the web, and triangular indentations 149 are formed at either ends of the struts defined by the triangular openings.

The beam 150 of FIG. 10 is a simple T-section having similar triangular openings and flanges and depressions as in the case of FIGS. 7, 8 and 9.

Many other forms of cold rolled sections can also be usefully improved and strengthened by the invention. For example, as shown in FIG. 11, a simple cold rolled channel 152 is illustrated, having a base wall 157, and having two side webs 154.

Triangular formations 156 are formed in the two side webs and triangular depressions 158 are formed in the webs as shown.

FIG. 12 illustrates another form of a cold rolled section, which is essentially a box like section 160, having a base wall 162 side webs 164, and two inturned walls 166.

Again, triangular openings of 168 are formed in the two side webs and triangular indentations 170 are formed as shown.

As shown in FIG. 13, another form of cold rolled section 172 is provided. In this case, the base wall 174 has a generally double right angular bend 176, designed for a particular application. Side webs 178 and 180 of differing widths extend from the base wall. One or both of the side webs are formed with triangular openings 182 and triangular indentations 183 as shown.

FIG. 14 illustrates an alternate form of channel 184 having a base wall 186, and side walls 188.

Triangular openings 190 and depressions 192 are formed in base wall 186.

Figure 15:
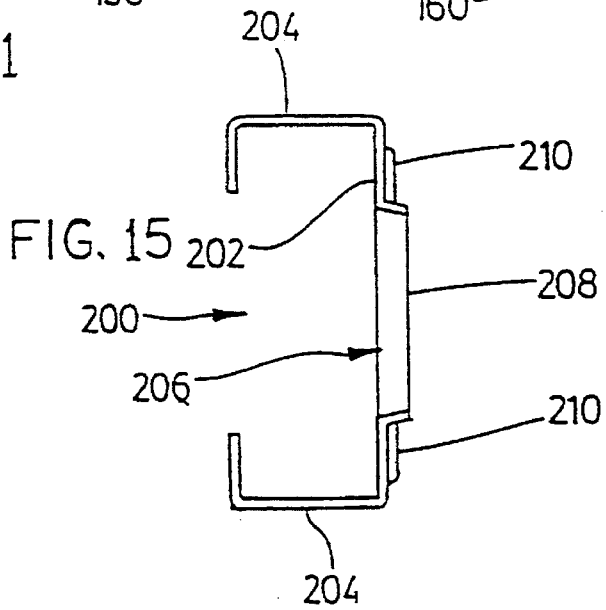

FIG. 15 illustrates a further alternate form of member 200 having a web 202, and side panels 204 extending to one side. Triangular openings 206 are formed but with their flanges 208 extending on the opposite side of web 202.

Depressions 210 are also formed, in web 202.

It will also be appreciated that in certain circumstances, if for example the saving in metal and saving in weight were not required, that the recesses or openings may be formed simply as indentations, without the metal being actually removed.

For the purposes of this description therefore reference to "openings" and to "openings" throughout the document is deemed to include recesses formed in the web, with or without the removal of the metal therefrom.

Figure 16:
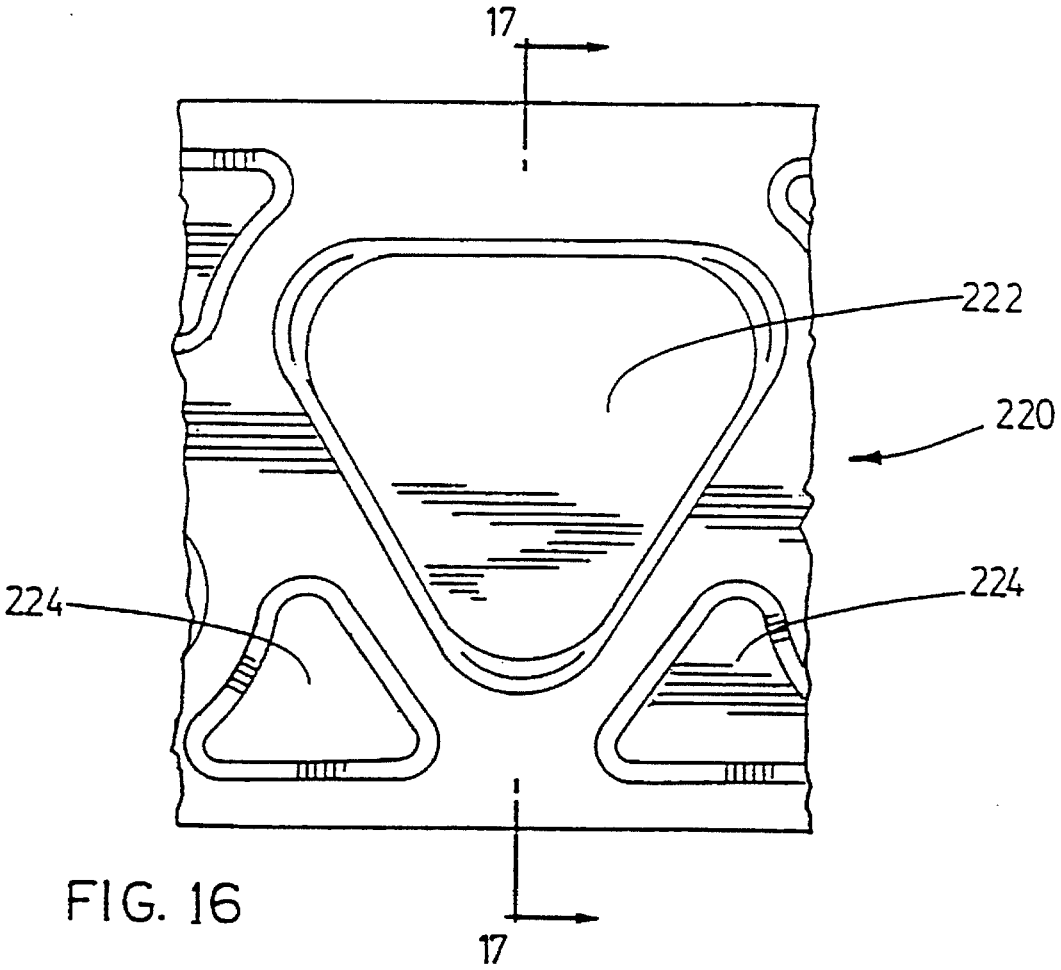
FIGS. 16 and 17 are respectively a side elevation and an end elevation of an alternate embodiment of metal member, in which no portion of the metal has been removed.
Figure 17:
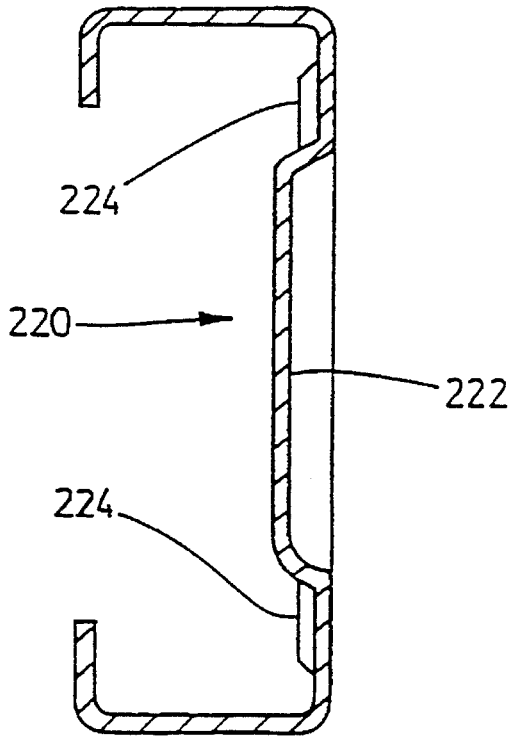

Referring to FIG. 16 and FIG. 17, there is shown a metal member 220 of generally similar design to the metal member of FIG. 5.

However, in this case the recesses 221, in this case of generally triangular shape, are formed as depressions in the metal, but without any metal being removed.

This member also has similar generally triangular reinforcement depressions 224 on either side of the central larger depression 222, giving the advantages described above in connection with the earlier embodiments.

Figure 18:
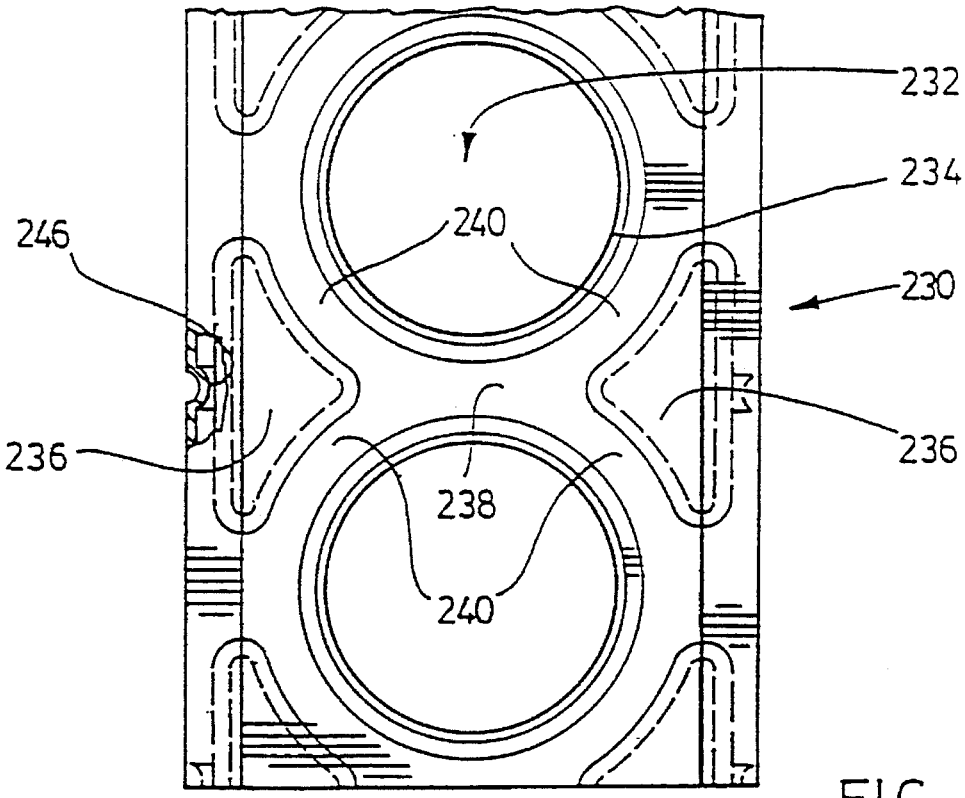
FIGS. 18 and 19 are respectively a side elevation and an end elevation of a further alternate embodiment of the metal member.
Figure 19:
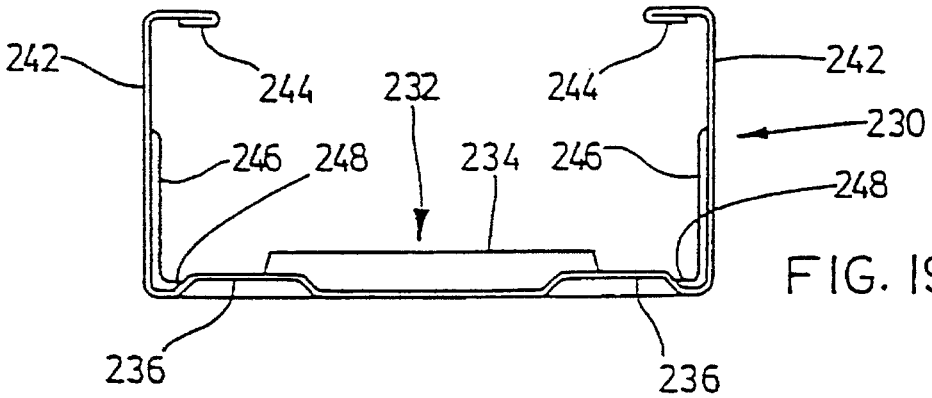

A further embodiment is illustrated in FIGS. 18 and 19. In this case, the metal member 230 is formed with recesses 232, which are circular in shape, and from which the metal has been removed. An annular edge flange 234 is formed around each opening 232. Generally triangular depressions 236—236 are formed in the web between adjacent recesses 232. In this way, struts 238 are formed between each of the recesses 232, each of which have diverging root portions 240—240.

The member 230 is also formed with right angular side flanges 242—242, having inturned edges 244—244.

Transverse reinforcement ribs 246 are formed in the side flanges 242, and merging reinforcing ribs 248 are formed in the web, and merged with the edges of triangular depressions 236.

In this way, the web is itself made rigid by the struts 238 and the flanges 234 and the depressions 236, and the side flanges 242 are further reinforced by the transverse ribs 246 and 248.

Figure 20:
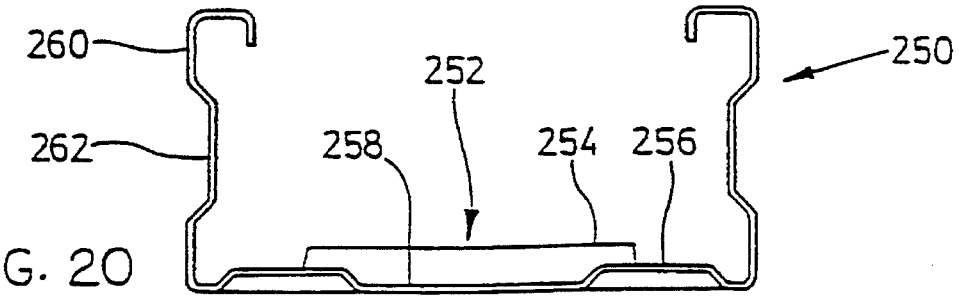
FIG. 20 is a section corresponding to FIG. 19, of a modification of the embodiment of FIG. 19.

A further embodiment is shown in FIG. 20. In this case, the metal member 250 has central circular recesses 252 similar to that illustrated in FIG. 18, with annular flange 254.

The general appearance of the web portion of the member 250 is similar to that of FIG. 18, and the member is formed with generally triangular reinforcement depressions 256—256 between adjacent recesses 252, thereby providing struts 258 extending therebetween, having great rigidity.

Side flanges 260 extend on either side of the web normal thereto, and have generally axial central depressions 262 formed therein, giving the member enhanced properties in certain respects.

Figure 21:
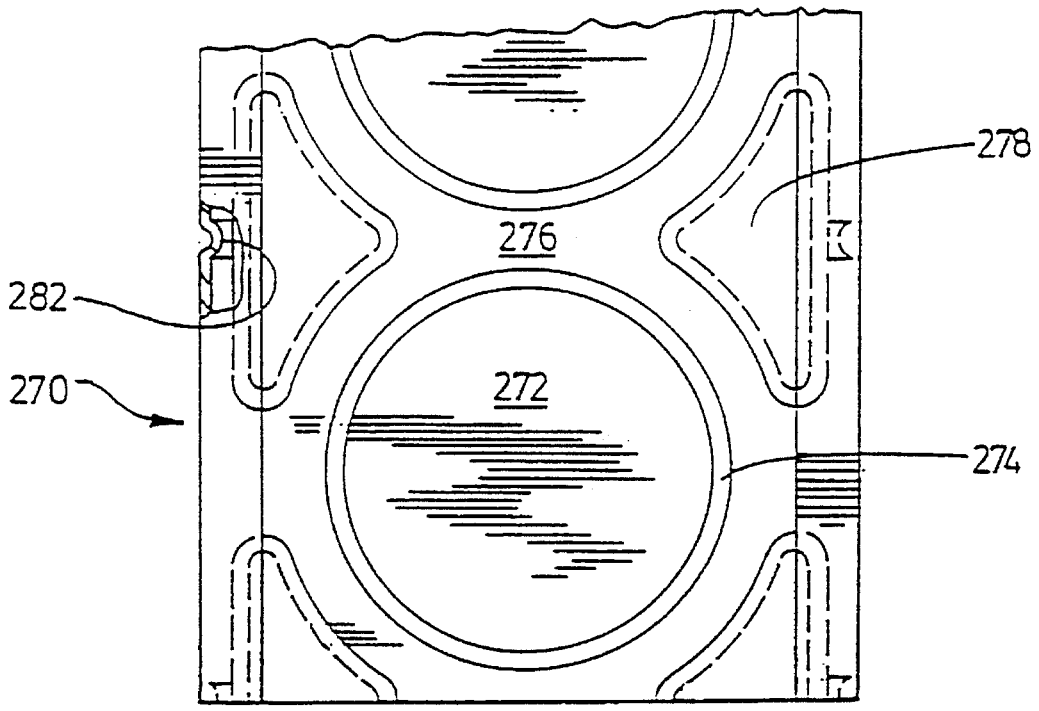
FIGS. 21 and 22 are respectively a side elevation and an end elevation of a further embodiment.
Figure 22:
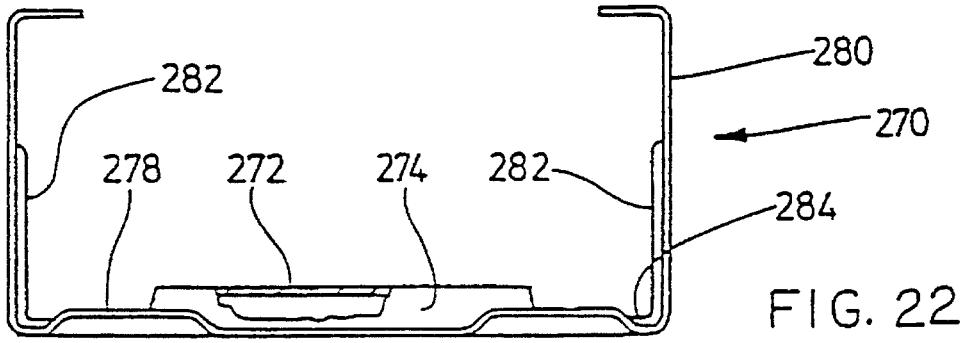

FIGS. 21 and 22 illustrate modifications of the embodiment of FIGS. 18 and 19. The modification in this case is that the central annular recesses 272 have not had metal removed, and consequently simply define annular side walls 274. Struts 276 are formed between the recesses. Triangular depressions 278 are formed at either end of the struts 276, thereby providing divergent strut roots.

Side flanges 280 extend upwardly from the web normal thereto, and are reinforced by transverse ribs 282 and 284.

Figure 23:
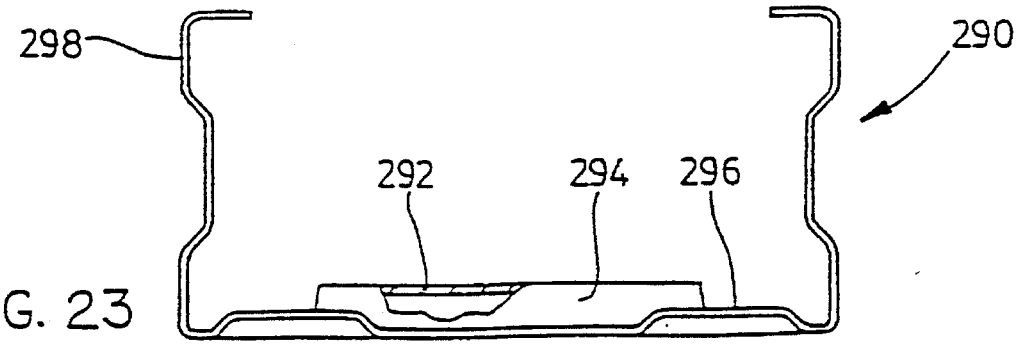
FIG. 23 is an end elevation of a modification of the embodiment of FIGS. 21 and 22, and, FIGS. 24 and 25 are respectively a side elevation and a section of a further embodiment.

FIG. 23 illustrates a further embodiment generally similar to the embodiment of FIG. 20.

In this case the metal member 290 has a central circular recess 292 again without metal removed. An annular flange 294 is formed around the recess 292. Triangular depressions 296 are formed in the web between adjacent recesses 292.

The side flanges 298 of the member 290 are generally similar in shape to the side flanges of the member 250 of FIG. 20.

Figure 24:
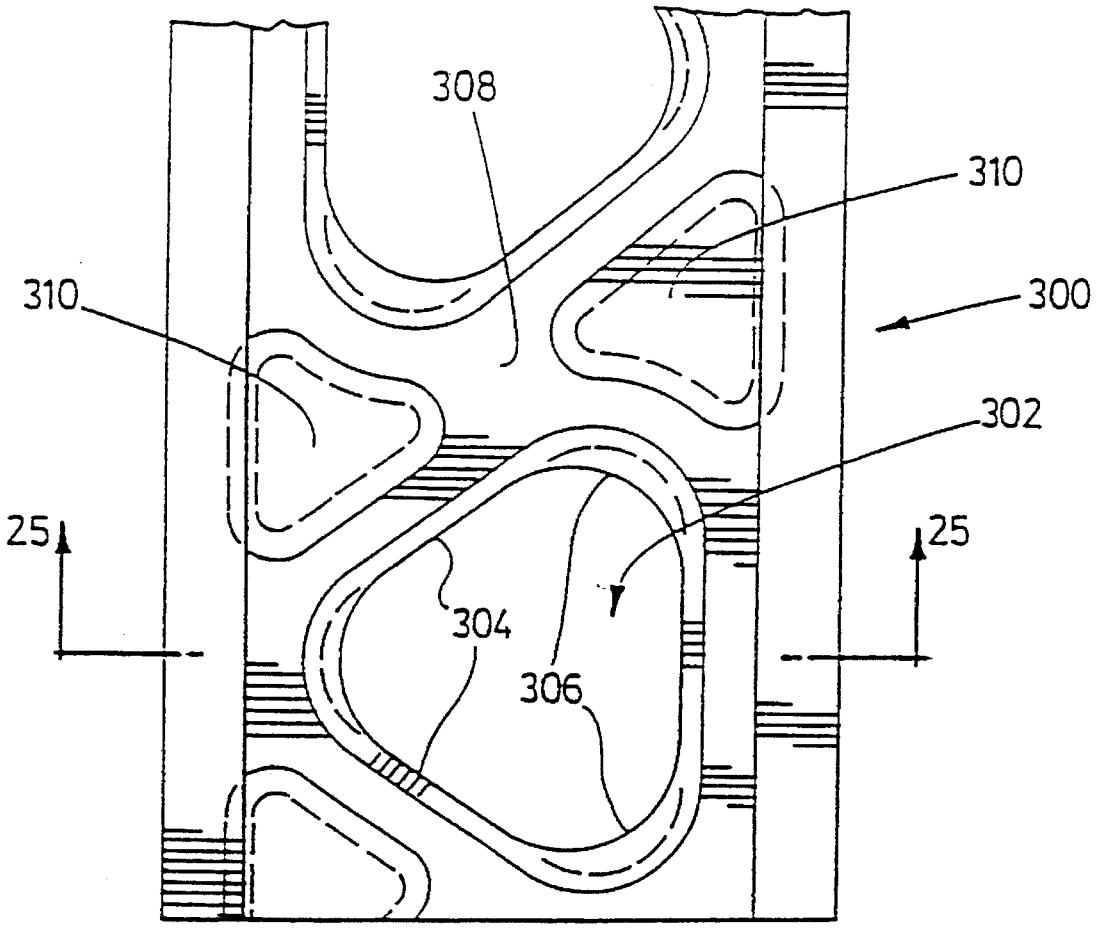
Figure 25:
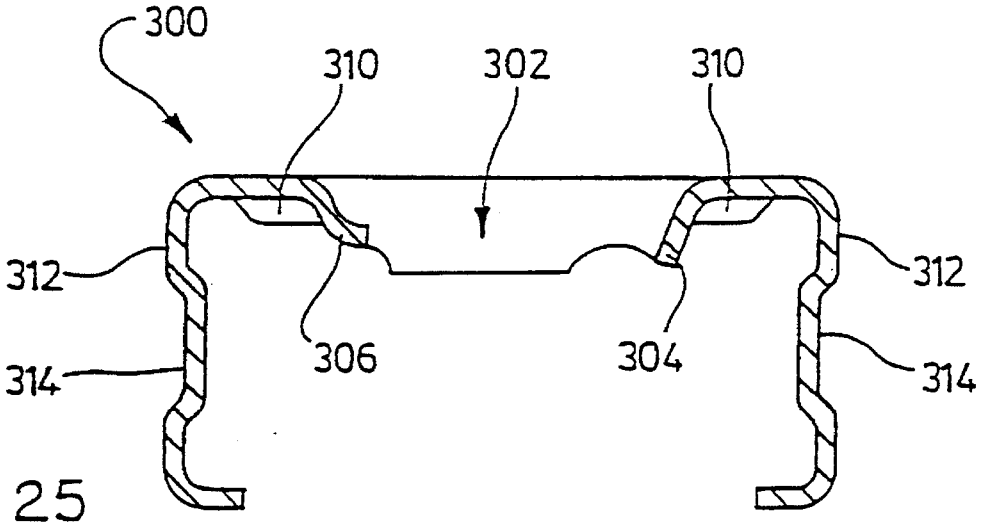

FIGS. 24 and 25 illustrate a further modified embodiment. In this case the metal member 300 is of generally similar design to the member 80 illustrated in FIGS. 5 and 6. It has central recesses 302 of generally triangular shape, having side flanges 304, and corner flanges 306 of generally scoop shape. Struts 308 are defined between the triangular recesses 302, and at each end of the struts, triangular reinforcement depressions 310 are formed, thereby providing generally divergent strut roots.

Side flanges 312 are formed normal to the web, and are formed with central reinforcement depressions 314.

While recesses of triangular shape, and recesses of circular shape have been described and illustrated, it will be appreciated that the invention is not restricted to recesses solely of such shape. Recesses of other shapes such as square, oval, hexagonal and the like and indeed any shape selected could be utilised with advantage in certain circumstances. In all cases such recesses may be utilised with or without the removal of metal.

The foregoing is a description of a preferred embodiment of the invention which is given here by way of example only. The invention is not to be taken as limited to any of the specific features as described, but comprehends all such variations thereof as come within the scope of the appended claims.

I claim:

1. A metal member (10), (70), (80), (120), (132), (150), (140), (152), (160), (172), (184), (200), (220) having at least one edge formation, web extending from said edge formation, a plurality of generally triangular formations (26), (92), (126), (148), (156), (168), (182), (190), (206), (222) formed in said web at spaced intervals, said triangular formations being alternately reversed relative to one another and defining a base and three corners, a plurality of generally diagonal struts (28), (106), (128) extending across said web between adjacent said triangular formations, edge portions (14, 16), (74,76), (84,86), (124) along either edge of said web, with said struts extending from one said edge portion to the other and merging integrally therewith, first flange formations (30,32), (94,96) formed from said web around said generally triangular formations along each side of said struts, and lying at an angle to said web, whereby to give said diagonal struts a generally channel shaped cross section, and, second flange formations (34), (98) formed along a further side of said triangular formations and forming intermittent flanges along said web edges, at said base of each said triangular formation, and comprising, corner flange formations (36, 38, 40) (100,102,104) extending around said corners of said triangular formations, said corner flange formations lying at an angle to said web which is less than said angle of said first flange formations;

generally three-sided reinforcement indentations (42,44), (108, 110), (130) formed in said web and extending partially into each end of each said diagonal strut, each of said three-sided indentations (42,44), (108,110), (130) comprising a first base side (46,52) which is linear and generally parallel with a said edge of said web, a second linear angled side (48, 54) extending from said base linear side and parallel to and spaced from a linear edge portion (32) of one of said generally triangular formations (26), thereby defining a substantially linear strut root portion (58, 60) formed from said web and merging into said respective diagonal strut and a curved third side (50, 56) extending from said base linear side and meeting said second linear side at an apex, and wherein said apex extends into said diagonal strut portion (28) of said web, wherein said curved third side (50, 56) of said generally three-sided indentation is spaced from the adjacent said curved base corner (36, 38) of a said generally triangular formation, thereby defining a generally curved strut root portion (62, 64), and wherein said linear strut root portion (58, 60) is spaced from said curved strut root portion (62, 64), whereby each said diagonal strut (28) extends from both a generally curved strut root portion and a linear strut root portion formed from said web; and, an indented web portion of three-sided shape extending between each said first base side (46, 52), said second linear angled side (48, 54), and said curved third side (50, 56).

2. A metal member (10) as claimed in claim 1, wherein said first and second flange formations (30,32,34,94,96,98) adjacent said corners of said generally triangular formations lie at an angle of between 75° and 85° relative to the plane of said web portion.

3. A metal member (10), (70), (80), (120), (132), (140), (150), (152), (220) as claimed in claim 1 wherein said corner flange formations (36, 38, 40) (100, 102, 104) are of generally curved shape in section.

4. A metal member (10) as claimed in claim 1, having an edge formation extending to one side of said web, and wherein said flange formations around said triangular formations (26), and wherein said indentations, both extend to the opposite side of said web.

5. A metal member (10) as claimed in claim 1 wherein said triangular formations (26) define generally triangular openings.

6. A metal member (10) as claimed in claim 1, wherein said indentations (42, 44) at each end of each said diagonal strut are reversed relative to each other.

7. A metal member (10) as claimed in claim 1, wherein said indentations (42, 44) at one end of said diagonal strut along said at least one edge formation of said web are alternately reversed relative to one another.

8. A metal member (10), (70), (80), (120), (132), (140), (150), (152), (160), (172), (184), (200), (220), (230), (250), (270), (290) having at least one edge formation, a web extending from said edge formation, a plurality of recesses (26), (92), (126), (148), (156), (168), (182), (190), (222), (232), (252), (272), (292) formed in said web at spaced intervals, along a generally median axis thereof, a plurality of struts (28), (106), (128) extending across said web between adjacent said recesses at an angle to said median axis, edge portions (14, 16), (74, 76), (84, 86), (124) along either edge of said web, with said struts extending from one said edge portion to the other and merging integrally therewith, and, flange formations (30–40), (94–104) formed from said web around said recesses, and lying at an angle thereto, whereby to give said struts a generally channel shaped cross section, and comprising, generally three-sided indentations (42, 44), (108, 110), (130) formed in said web, at each end of each of said struts, said three-sided indentations (42, 44), (108, 110), (130) being indented into said web and extending partially into each end of each said strut, each of said three-sided indentations (42, 44), (108, 110), (130) comprising a first base side (46, 52) which is linear and generally parallel with a said edge of said web, at least a second curved side (50, 56) extending from said first base linear side and meeting a third side (48, 54) at an apex, and wherein said apex extends into a respective said strut portion of said web, wherein said side (50, 56) of each said generally three-sided indentation (42, 44), (108, 110), (130) is spaced from an adjacent corner of a said recess, thereby defining a first generally curved strut root portion (62, 64) and wherein said third side (48, 54) of said three-sided indentations is linear and extends generally parallel to and spaced from a linear edge (32) of portion of one of said web portion, thereby defining a substantially linear strut portion (58, 60) extending from said web into said respective diagonal strut, and spaced from said curved strut portion, whereby each said diagonal strut (28) extends from both a generally curved strut portion (62, 64) and a linear strut portion (58, 60) extending from said web; and, an indented web portion of three-sided shape extending between each said first base side (46, 52), said second curved side (50, 56), and said linear third side (48, 54).

9. A metal member (10), (70), (80), (120), (132), (140), (150), (152), (160), (172), (184), (200), (220), (230), (250), (270), (290) as claimed in claim 8, and wherein said an edge formation extends to one side of said web, and wherein said flange formations around said recesses, and wherein said indentations extend to the opposite side of said web.

10. A metal member (10), (70), (80), (120), (132), (140), (150), (152), (160), (172), (184), (200), as claimed in claim 8, wherein said recesses (26), (92), (126), (148), (156), (168), (182), (190), (222) are of generally triangular shape and define a first side parallel with a said edge of said web, and two further sides extending diagonally, and wherein curved base corners extend between said first side and said further sides, and wherein said further sides meet at a curved apex corner, and wherein said struts are defined by diagonal portions of said web between adjacent said triangular recesses and wherein said apex corner of one of said triangular recesses and an adjacent curved base corner of another said triangular recess, define between them enlarged end portions at each end of each of said struts.

11. A metal member (10), (70), (80), (120), (132), (140), (150), (152), (160), (172), (184), (200), as claimed in claim 10, wherein said flange formations around said corners of said generally triangular formations lie at an oblique angle relative to the plane of said web.

12. A metal member (10), (70), (80), (120), (132), (140), (150), (152), (160), (172), (184), (200), as claimed in claim 10 and wherein said three-sided indentations comprise a first base side (46, 52) which is linear and generally parallel with a said edge of said web, a second linear angled side (48, 54) extending from said base linear side, and a third curved side (50, 56) extending from said first base linear side and meeting said second linear side at an apex, and wherein said apices extend into said enlarged end portions of said struts.

13. A metal member as claimed in claim 8 wherein said recesses define openings through said web.

* * * * *